United States Patent [19]

Arakida et al.

[11] Patent Number: 4,767,508

[45] Date of Patent: Aug. 30, 1988

[54] STRIKE PLATING SOLUTION USEFUL IN APPLYING PRIMER PLATING TO ELECTRONIC PARTS

[75] Inventors: Yasuhiro Arakida; Kazuhiko Fukamachi, both of Kanagawa, Japan

[73] Assignee: Nippon Mining Co., Ltd., Tokyo, Japan

[21] Appl. No.: 16,942

[22] Filed: Feb. 20, 1987

[30] Foreign Application Priority Data

Feb. 27, 1986 [JP] Japan ..... 61-40297
Feb. 27, 1986 [JP] Japan ..... 61-40298
Feb. 27, 1986 [JP] Japan ..... 61-40299

[51] Int. Cl.[4] ..... C25D 3/56
[52] U.S. Cl. ..... 204/44.5
[58] Field of Search ..... 204/44.5

[56] References Cited

U.S. PATENT DOCUMENTS 4,014,759 3/1977 McMullen et al. ..... 204/44.5
4,129,482 12/1978 Lash ..... 204/44.5
4,384,930 5/1983 Eckles ..... 204/55.1 X

FOREIGN PATENT DOCUMENTS 13078 4/1985 Japan ..... 204/44.5

OTHER PUBLICATIONS

C. B. F. Young et al., The Electrochemical Soc., Preprint 89-1, pp. 3-31, (1946).

*Primary Examiner*—G. L. Kaplan
*Attorney, Agent, or Firm*—Oblon, Fisher, Spivak, McClelland & Maier

[57] ABSTRACT

Disclosed herein is a noble metal plated material having good solderability and bonderability and suited for use as parts of electronic and electric equipment as well as a strike plating solution useful in the formation of a primer plating upon production of the plated material. The strike plating solution comprises 5-300 g/l of nickel chloride, 5-300 g/l of cobalt chloride and 30-300 g/l of hydrochloric acid.

2 Claims, No Drawings

STRIKE PLATING SOLUTION USEFUL IN APPLYING PRIMER PLATING TO ELECTRONIC PARTS

BACKGROUND OF THE INVENTION

1. Field of the Invention

This invention relates to a noble metal plated material applied with a noble metal plating and employed for parts of electronic and electric equipment, such as lead frames and terminal connectors, and to a strike plating solution useful for the formation of a primer plating of the plated material.

2. Description of the Prior Art

Plated materials, each of which is composed of a metal plate such as copper alloy or stainless steel plate and a noble metal plating of gold(Au), silver(Ag) or the like applied thereon, have been used widely for parts of various electronic and electric equipment owing to their excellent chemical and physical properties. Plated materials applied with such noble metal platings as mentioned above are however very expensive due to the high prices of the noble metals. It is hence desired to make their plating layers as thin as possible. On the other hand, noble metal plated materials as parts of electronic and electric equipment may be exposed to heat as high as several hundred degrees. In such a high-temperature atmosphere, the noble metal plated materials involve such problems that their solderability, bonderability and the like may be deteriorated considerably and tarnishing may also take place due to oxidation of the basis metals of the plated materials, diffusion of the basis metals into their corresponding noble metal plating layers, etc.

With a view toward avoiding the above-mentioned quality deterioration of a noble metal plated material in such a high-temperature atmosphere, it is now practiced to apply a primer plating before application of a noble metal plating to a basis metal as a material to be plated. For example, it has already been attempted to plate Sn—Ni, Sn—Co, Ni or the like as a primer plating on stainless steel as a metal to be plated. Namely, by using a plating solution which contains $NiCl_2$ and HCl and is a nickel strike plating solution called "Wood's bath", stainless steel as a material to be plated is plated for about 2 -4 minutes at a current density of 2-20 $A/dm^2$ so as to apply a primer plating in the form of a nickel plating layer of about 1 $\mu$m thick, followed by further plating of a noble metal such as Au or Ag on the primer plating.

Even if such a primer plating is applied, it is still impossible to obtain a noble metal plated material capable of exhibiting sufficient solderability and bonderability after being held for about 3 minutes in an air atmosphere of 450° C. so long as its noble metal plating layer is for example an Au or Ag plating as thin as 0.1 $\mu$m or so. It is therefore indispensable to apply a noble metal plating of a significant thickness on a primer plating in order to obtain sufficient solderability and bonderability. The aforementioned problem that the high costs of noble metal plated materials are unavoidable still remains accordingly.

It may be contemplated to use a copper strike plating solution, which is routinely employed to form a film having good adhesion to a basis metal such as steel or a diecasting zinc alloy, for the formation of a primer plating for a noble metal plated material, since the copper strike plating solution can also improve the bonding properties of noble metal platings such as gold platings and silver platings. A noble metal plated material, which has been obtained by applying a primer plating in the copper strike plating solution and then forming a noble metal plating such as gold or silver plating on the primer plating, however shows a sign of reduced heat resistance that its solderability and bonderability (wire bonderability) are lowered to a significant extent, when it is heated in the atmosphere. Use of such noble metal plated materials for parts of electronic and electric equipment such as lead frames and terminal connectors, has hence been accompanied by a drawback that the reliability is poor.

It has thus been attempted to use a cobalt-nickel alloy plating as the above-mentioned primer plating in order to avoid the deterioration of heat resistance.

Plating baths for such cobalt-nickel platings generally include those making use of sulfates, chlorides, sulfate/-chloride mixtures, sulfamates, borofluorates, pyrophosphates, etc. These plating baths are employed for plating magnetic materials, molds for plastics and hard press dies, ornaments and accessories, copper alloys and stainless steel, etc.

Such a cobalt-nickel alloy plating is conducted at a high cathode efficiency, usually, of 30% or higher in view of productivity and cost. It has hence been extremely difficult to plate a dense and thin film evenly. The solderability and bonderability of plated materials applied with cobalt-nickel alloy platings has not been improved as much as they were expected. Moreover, there is another drawback of inefficiency in plating work that nickel strike plating must be applied in advance before applying a cobalt-nickel alloy plating on stainless steel. Cobalt-nickel alloy platings are therefore not satisfactory as primer platings for noble metal plated materials which are employed as lead frames, terminal connectors and the like.

SUMMARY OF THE INVENTION

A principal object of the present invention is to provide a noble metal plated material capable of showing satisfactory good solderability and bonderability, even after being held for 3 minutes in an atmosphere of 450° C., by applying dn a metal plate a cobalt-nickel alloy strike plating layer as a primer plating for a noble metal plating even when the noble metal plating layer is formed with a small thickness.

Another object of this invention is to provide a cobalt-nickel alloy strike plating solution useful for the formation of a primer plating for the above-described noble metal plating.

Other objects of this invention will become apparent from the following description.

DETAILED DESCRIPTION OF THE INVENTION

In the present invention, the cobalt-nickel alloy plating employed as the primer plating for the noble metal plated material is applied by using a cobalt-nickel alloy strike plating solution. The strike plating solution useful in the practice of this invention is formed of nickel chloride, cobalt chloride and hydrochloric acid. It may comprise preferably 5 g/l-300 g/l of nickel chloride, 5 g/l-300 g/l of cobalt chloride and 30 g/l-300 g/l more, preferably, 50 g/l-200 g/l of hydrochloric acid. A dense plating film can be obtained by using a strike plating solution of such a composition.

If the concentration of at least one of nickel chloride and cobalt chloride in a strike plating solution is below 5 g/l, the ion concentration of the corresponding metal is too low to provide a dense plating film. If the concentration of at least one of the components exceeds 300g/l on the other hand, the resulting electro-deposit tends to become granular and the viscosity of the plating solution increases so much that the pump-out rate of the plating solution has to be increased. This is certainly disadvantageous from the economical viewpoint.

If the concentration of hydrochloric acid in the plating solution is lower than 30 g/l, the activating effects of hydrochloric acid are not sufficiently exhibited so that the removal of a passivated film on stainless steel cannot be fully achieved, thereby failing to provide a plating film having good adhesion. Even if the concentration of hydrochloric acid in the plating solution exceeds 300 g/l on the other hand, no additional effects can be observed.

In addition, a surfactant can be added to the above strike plating solution in the present invention. When plating is conducted by using a plating solution with a surfactant added thereto, particles are deposited in finer sizes so that a dense plating film is obtained. In addition, another advantageous effect is also observed in that the use of a surfactant can minimize the occurrence of undesirable defects such as pits and pinholes.

Exemplary surfactants usable in the present invention include anionic surfactants such as polyoxyethylene alcohol ethers and polyoxyethylene alkylphenol ethers and non-ionic surfactants such as polyethylene glycol alcohol ethers, polyethylene glycol alkylphenol ethers and polyethylene glycol fatty acids. These surfactants may be employed either singly or in combination. The surfactant may be added in an amount of 30 g/l or less, preferably, 10 g/l or less to the above plating solution. If it is added in a total amount greater than 30 g/l, the plating solution is rendered susceptible to considerable foaming and the use of the surfactant at such a high concentration is hence undesirable, although no special problem arises as to the characteristics of the resulting electro-deposit.

When applying a primer plating on a basis metal, which is a material to be plated, with the above-described cobalt-nickel alloy strike plating solution of this invention, the following conditions can be employed. Bath temperature: 5 -50° C., preferably, 10-40° C. Current density: 0.1 -20 A/dm$^2$, preferably, 1-15 A/dm$^2$. Upon conducting the plating, stirring is not specifically required. It may be conducted in a stationary state. Although the anode may desirably be a nickel plate, cobalt plate or cobalt-nickel alloy plate, an insoluble platinum-plated titanium plate or the like may also be used.

As a basis metal on which the above-mentioned primer plating is applied, namely, as a material to be plated, it is possible to use copper and copper alloys, iron and iron alloys, metallized ceramic materials, and the like. When the basis material is a stainless steel plate, the thickness of a cobalt-nickel alloy plating layer may preferably be at least 0.01 μm but thinner than 0.1 μm. In this thickness range, the solder-abilitly and bonderability of the noble metal plating applied on the stainless steel is improved significantly. Even if the thickness of a cobalt-nickel strike plating is smaller than 0.01 μm or is 0.1 μm or greater, the thus-plated material has either equal or better quality compared with conventional plated materials, each of which has been obtained by applying a nickel strike plating on stainless steel, plating a cobalt-nickel alloy on the nickel strike plating and then plating a noble metal on the cobalt-nickel alloy, and the like.

The noble metal plated material of this invention has, as mentioned above, a cobalt-nickel alloy plating plate as a primer plating on a basis metal plate and a noble metal plating layer on the primer plating. When a plating of gold or a gold alloy is applied as a noble metal plating layer, the above cobalt-nickel alloy plating layer may preferably be applied as a primer plating in the form of a plating layer consisting of at least 60 wt.% of cobalt and the remainder of nickel. When a plating of silver or a silver alloy is applied as a noble metal plating layer on the other hand, it is preferable to apply as a primer plating a cobalt-nickel alloy plating layer consisting of 2 wt.% or more of cobalt and the remainder of nickel.

By applying a cobalt-nickel alloy plating layer on a basis metal as a material to be plated and then a noble metal plating of gold or silver as mentioned above, the solderability and bonderability of the noble metal plating do not show any reduction even after being held for 3 minutes in an air atmosphere of 450° C., even when the plating layer of gold is as thin as about 0.1 μm or the plating layer of silver is as thin as about 0.5 μm.

Since the present invention allows reduction in thickness of a noble metal plating layer without deleteriously affecting its solderability and bonderability, it is possible to lower the prices of noble metal plated materials which are useful for parts of electronic and electric equipment.

Needless to say, the present invention also permits application of an additional primer plating either before or after applying a cobalt-nickel alloy strike plating as a primer plating on a basis metal. Accordingly, this invention also embraces noble metal plated materials with additional primer platings such as that mentioned above.

The above-described cobalt-nickel strike plating solution is used to form a primer plating in the production of a noble metal plated material of this invention. It is possible to adjust easily the components of the resulting electro-deposit by modifying the composition of the plating solution. In addition, the plating solution is easy to handle.

The present invention will hereinafter be described specifically by the following Examples. It should however be borne in mind that the present invention is not limited by or to the following Examples.

EXAMPLE 1:

Formulation of cobalt-nickel alloy strike plating solution (bath):

| | |
|---|---|
| Bath Composition (1): | |
| Cobalt chloride | 100 g/l |
| Nickel chloride | 150 g/l |
| Hydrochloric acid | 100 g/l |
| Bath Composition (2): | |
| Cobalt chloride | 50 g/l |
| Nickel chloride | 200 g/l |
| Hydrochloric acid | 150 g/l |
| Polyoxyethylene lauryl alcohol ether | 2 g/l |

Conditions for primer plating:

Phosphor bronze strips (0.2 mm thick) were used as basis metal materials to be plated. After degreasing the strips with acetone, they were subjected to electrolytic degreasing at 40° C. in a solution in which 45 g/l of "CLEANER 160"(trade name; product of Japan Metal Finishing Co., Ltd.) was contained, followed by dipping in a 5 vol.% aqueous solution of sulfuric acid. Thereafter, a cobalt-nickel alloy strike plating was applied as a primer plating on each of the strips under the following conditions. In the case of the plating solution of Bath Composition (1), the primer plating was applied at 20° C. and 5 A/dm$^2$ to a thickness of 0.02 μm. The thus-obtained plating layer consisted of 10 wt.% of Ni and 90 wt.% of Co. In the case of the plating solution of Bath Composition (2), the primer plating was applied at 20° C. and 1 A/dm$^2$ to a thickness of 0.03 μm. The thus-obtained plating layer consisted of 25 wt.% of Ni and 75 wt.% of Co.

Conditions for noble metal plating:

On each of the cobalt-nickel alloy strike platings applied above, a gold or silver plating was applied under the following conditions.

| | |
|---|---|
| Gold plating: | |
| Bath component: | "TEMPELEX 401" (trade name; product of TANAKA KIKINZOKU KOGYO K.K.) |
| Temperature: | 65° C. |
| Current density: | 0.5 A/dm$^2$ |
| Thickness of plating: | 0.1 μm |
| Silver plating: | |
| Bath component: | "SIVLEXJS-1" (trade name; product of TANAKA KIKINZOKU KOGYO K.K.) |
| Temperature: | 20° C. |
| Current density: | 1 A/dm$^2$ |
| Thickness of plating: | 0.5 μm |

In order to evaluate the quality of the platings of the above-obtained noble metal plated materials, the plated materials were each heat-treated for 3 minutes in an air atmosphere of 450° C. Thereafter, their solderability and bonderability were tested in accordance with the following methods:

Solderability Testing Method

After dipping each sample for 5 seconds in a 25% rosin methanol, the sample was dipped for 5 seconds in a bath of 60/40 (Sn/Pb) soft solder maintained at 240 ±5° C. The solderability of the sample was evaluated by the external appearance of the sample after its dipping in the bath and $T_2$ (the time required until the buoyancy became 0. A shorter $T_2$ indicates better wettability.) obtained from its wetting curve.

Bonderability testing method

A gold wire of 25 μm in diameter was bonded on each sample by applying "Ball Wedge Bond" at intervals of 1 mm. The bonderability of the sample was evaluated in terms of the tensile strength. (n =20).

As Comparative Examples, gold platings and silver platings were separately applied to phosphor bronze strips in the same manner as in Example 1. The phosphor bronze strips had also been pretreated in the same manner as in Example 1. The quality of the platings of the thus-obtained plated materials was then evaluated by the same testing methods.

| | |
|---|---|
| (3) Nickel strike plating: | |
| Bath composition: | |
| Nickel chloride | 250 g/l |
| Hydrochloric acid | 150 g/l |
| Plating conditions: | |
| Temperature: | 20° C. |
| Current density: | 5 A/dm$^2$ |
| Thickness of plating: | 0.02 μm and 0.1 μm |
| (4) Copper strike plating: | |
| Bath composition: | |
| Copper cyanide | 20 g/l |
| Sodium prussiate | 30 g/l |
| Plating conditions: | |
| Temperature: | 20° C. |
| Current density: | 5 A/dm$^2$ |
| Thickness of plating: | 0.1 μm |
| (5) Nickel-cobalt alloy plating: | |
| Bath composition: | |
| Nickel sulfate | 135 g/l |
| Cobalt sulfate | 115 g/l |
| Boric acid | 25 g/l |
| Potassium chloride | 15 g/l |
| Plating conditions: | |
| Temperature | 40° C. |
| Current density | 1 A/dm$^2$ |
| Thickness: | 2 μm |

The resultant nickel-cobalt alloy plating layer consisted of 30 wt.% of Ni and 70 wt.% of Co.

Results of the above tests are summarized in Table 1.

TABLE 1

| No. | Primer plating | Surface layer | Solderability* $T_2$ (sec) | Solderability* External appearance | Bonderability** Tensile strength (g) |
|---|---|---|---|---|---|
| Invention Example | | | | | |
| 1 | Ni—Co alloy strike | Au | 0.53 | 0 | 7.3 |
| | (0.02 μm) | Ag | 0.41 | 0 | 7.9 |
| 2 | Ni—Co alloy strike | Au | 0.60 | 0 | 7.4 |
| | (0.03 μm) | Ag | 0.42 | 0 | 7.4 |
| Comparative Example | | | | | |
| 3 | Ni strike | Au | — | X | 7.3 |
| | (0.02 μm) | Ag | 0.32 | X | 7.7 |
| 4 | Ni strike | Au | — | X | 7.3 |
| | (0.1 μm) | Ag | 0.28 | X | 7.0 |
| 5 | Cu strike | Au | — | X | — |
| | (0.1 μm) | Ag | — | X | 3.4 |
| 6 | Ni—Co alloy strike | Au | — | X | 4.4 |

TABLE 1-continued

| No. | Primer plating | Surface layer | Solderability* $T_2$ (sec) | Solderability* External appearance | Bonderability** Tensile strength (g) |
|---|---|---|---|---|---|
| | (2 μm) | Ag | — | X | 7.1 |

*Solderability: $T_2$: — Wettability was not exhibited at all. External appearance: 0 Wettability of 96% or higher. X Wettability less than 40%.
**Bonderability: — Bonding was not feasible.

The present invention has brought about numerous excellent advantageous effects. As readily envisaged from Table 1 for instance, a noble metal plated material obtained by applying a cobalt-nickel alloy strike plating as a primer plating with a cobalt-nickel alloy strike plating solution in accordance with this invention has better solderability and bonderability compared with a noble metal plated material obtained by applying a conventional nickel strike, copper strike or nickel-cobalt alloy plating and then plating a noble metal thereon. In addition, the former noble metal plated material allows the reduction of the thickness of its noble metal plating, leading to an advantage that the product cost can be lowered.

Example 2

After degreasing SUS 430 strips (0.1 mm thick) with acetone, they were subjected to electrolytic degreasing at 40° C. in a solution in which 45 g/l of "CLEANER 160"(trade name; product of Japan Metal Finishing Co., Ltd.) was contained, followed by dipping in an aqueous solution containing 100 g/l of hydrochloric acid. Thereafter, noble metal platings were separately applied in accordance with the following procedure.

(1) Cobalt-nickel alloy strike plating (primer plating)

Using a bath having a composition of 50 g/l of cobalt chloride, 200 g/l of nickel chloride and 100 g/l of hydrochloric acid, primer platings were applied respectively on some of the SUS 430 strips at 20° C. and 5A/dm$^2$. The thus-obtained plating layers consisted of 30 wt.% of Ni and 70 wt.% of Co.

(2) Noble metal plating

On each of the SUS 430 strips which had been applied with the primer platings as described above, a gold or silver plating was then applied in the following manner.

| | |
|---|---|
| Gold plating: | |
| Bath component: | "TEMPELEX 701" (trade name; product of TANAKA KIKINZOKU KOGYO K.K.) |
| Temperature: | 50° C. |
| Current density: | 0.5 A/dm$^2$ |
| Thickness of plating: | 0.1 μm |
| Silver platings: | |
| (1) Silver strike plating: | |
| Bath components: | sodium silver cyanide 3 g/l + sodium prussiate 98 g/l. |
| Temperature: | room temperature |
| Current density: | 1 A/dm$^2$ |
| Thickness of plating: | 0.1 μm |
| (2) Silver plating: | |
| Bath component: | "SILVLEX JS-2" (trade name; product of TANAKA KINZOKU KOGYO K.K.) |
| Temperature: | 40° C. |
| Current density: | 1 A/dm$^2$ |

-continued

| | |
|---|---|
| Thickness of plating: | 0.4 μm |

In order to evaluate the quality of the platings of the above-obtained noble metal plated materials, the plated materials were each heat-treated for 3 minutes in an air atmosphere of 450° C. Thereafter, their solderability and bonderability were tested in the same manner as in Example 1.

As Comparative Examples, the following platings were applied on the SUS 430 strips similar to those used in Example 2. The thus-plated strips were each applied with gold or silver plating in the same manner as in Example 2. The quality of the platings of the thus-obtained plated materials was then evaluated by the same testing methods.

| | |
|---|---|
| (3) Nickel strike plating: | |
| Bath composition: | |
| Nickel chloride | 250 g/l |
| Hydrochloric acid | 100 g/l |
| Plating conditions: | |
| Temperature: | 20° C. |
| Current density: | 5 A/dm$^2$ |
| Thickness of plating: | 0.02 μm |

(4) NicDel-cobalt alloy plating

On the above-applied nickel strike plating of 0.02 μm, a nickel-cobalt alloy plating was applied further under the following conditions.

| | |
|---|---|
| Bath composition: | |
| Nickel sulfate | 135 g/l |
| Cobalt sulfate | 115 g/l |
| Boric acid | 25 g/l |
| Potassium chloride | 15 g/l |
| Plating conditions: | |
| Temperature: | 40° C. |
| Current density: | 1 A/dm$^2$ |
| Thickness of plating: | 0.1 μm |

The thus-obtained alloy film consisted of 30 wt.% of Ni and 70 wt.% of Co.

(5) Nickel-tin alloy plating:

On the above-applied nickel strike plating of 0.02 μm, a nickel-tin alloy plating was applied further under the following conditions.

| | |
|---|---|
| Bath composition: | |
| Stannous chloride | 50 g/l |
| Nickel chloride | 300 g/l |
| Sodium fluoride | 28 g/l |
| Acidic ammonium fluoride | 35 g/l |
| Plating conditions: | |
| Temperature | 65° C. |
| Current density | 0.5 A/dm$^2$ |

-continued

| | |
|---|---|
| Thickness: | 0.5 μm |

The resultant nickel-tin alloy plating layer consisted of 33 wt.% of Ni and 67 wt.% of Sn.

Results of the above tests are summarized in Table 2.

TABLE 2

| No. | Primer plating | Surface layer | Solderability* $T_2$ (sec) | Solderability* External appearance | Bonderability** Tensile strength (g) |
|---|---|---|---|---|---|
| Inv. Ex. | | | | | |
| 1 | Ni—Co alloy strike | Au | 0.53 | 0 | 7.3 |
| | (0.02 μm) | Ag | 0.60 | 0 | 7.9 |
| Comparative Example | | | | | |
| 2 | Ni strike | Au | — | X | 7.3 |
| | (0.02 μm) | Ag | 0.32 | X | 7.7 |
| 3 | Ni strike (0.02 μm) + Ni—Co alloy | Au | 3.54 | Δ | 7.8 |
| | (0.1 μm) | Ag | 0.28 | X | 7.5 |
| 4 | Ni strike (0.02 μm) + Ni—Sn alloy | Au | — | X | — |
| | (0.5 μm) | Ag | — | X | 7.5 |

*Solderability: $T_2$: — Wettability was not exhibited at all. External appearance: 0 Wettability of 96% or higher. Δ Wettability of 40% or higher and less than 96%. X Wettability less than 40%.
**Bonderability: — Bonding was not feasible.

As shown in Table 2, it is understood that the plated materials of the Invention Example are superior in the solderability and bonderability after heat-treated at 450° C. for 3 minutes to the plated materials of the Comparative Examples.

Example 3

After degreasing and acid-pickling SUS 430 strips (0.01 mm thick) and phosphor bronze strips (0.20 mm thick) by methods known per se in the art, they were each applied with a noble metal plating in accordance with the following procedure.

(1) Nickel-cobalt alloy strike plating

Using a bath having a composition of 100 g/l of cobalt chloride, 150 g/l of nickel chloride and 100 g/l of hydrochloric acid, nickel-cobalt alloy strike platings were applied respectively as primer platings on some of the SUS 430 strips and phosphor bronze strips at 20° C. and 5A/dm$^2$ to a thickness of 0.02 μm.

(2) Noble metal plating

On each of the SUS 430 strips and phosphor bronze strips which had been applied respectively with the primer platings as described above, a gold or silver plating was then applied in the following manner.

| | |
|---|---|
| Gold plating: | |
| Bath component: | "TEMPELEX 701" (trade name; product of TANAKA KIKINZOKU KOGYO K.K.) |
| Temperature: | 50° C. |
| Current density: | 0.5 A/dm$^2$ |
| Thickness of plating: | 0.1 μm |
| Silver plating: | |
| Bath component: | "SILVLEX JS-2" (trade name; product of TANAKA KINZOKU KOGYO K.K.) |
| Temperature: | 20° C. |
| Current density: | 1 A/dm$^2$ |
| Thickness of plating: | 0.5 μm |

In order to evaluate the quality of the platings of the above-obtained noble metal plated materials, the plated materials were divided into three groups. The plated materials in first and second groups were heat-treated in an air atmosphere of 450° C. for 60 seconds and 180 seconds respectively. The plated materials in the third group were not subjected to any heat treatment. Their solderability and bonderability were then tested in the same manner as in Example 1.

As Comparative Examples, the following platings were applied separately on stainless steel strips and phosphor bronze strips similar to those employed in Example 2. Furthermore, the thus-treated strips were each applied with a gold or silver plating in the same manner as in Example 2. The quality of the platings of the thus-obtained plated materials was then evaluated by the same testing methods.

(3) Nickel strike plating +nickel-cobalt alloy plating

Using a bath having a composition of 250 g/l of nickel chloride and 100 g/l of hydrochloric acid, a nickel strike plating was applied on each stainless steel strip at 20° C. and 5 A/dm$^2$ to a thickness of 0.02 μm. Using a bath having a composition of 13 g/l of nickel sulfate, 115 g/l of cobalt sulfate, 25 g/l of boric acid and 15 g/l of potassium chloride, a nickel-cobalt alloy plating was applied further on the nickel strike plating at 40° C. and 1A/dm$^2$ to a thickness of 0.1 μm.

Besides, a nickel-cobalt alloy plating was also applied to a thickness of 0.5 μm on each stainless steel strip with a nickel strike plating of 0.02 μm applied thereon.

(4) Nickel-tin alloy plating

Using a bath having a composition of 50 g/l of stannous chloride, 300 g/l of nickel chloride, 28 g/l of sodium fluoride and 35 g/l of acidic ammonium fluoride, a nickel-tin plating was applied on a phosphor bronze strip at 65° C. and 0.5 A/dm$^2$ to a thickness of 0.1 μm.

Similarly, a nickel-tin alloy plating was applied to a thickness of 0.5 μm on a phosphor bronze strip.

(5) Nickel strike plating +palladium-nickel alloy plating

Using a nickel strike plating bath similar to that employed in the above procedure (3), a nickel strike plating was applied on a stainless steel to a thickness of 0.02 μm under similar conditions. Using "PNP-80EC"(trade mark; product of Nissin Kasei Co., Ltd.), a palladium-nickel alloy plating was applied on the nickel strike plating at 30° C. and 1.0 A/dm$^2$ to a thickness of 0.1 μm.

Similarly, a palladium-nickel alloy plating was applied to a thickness of 0.5 μm on a stainless steel strip with a nickel strike plating applied to a thickness of 0.02 μm.

Results of the above tests are summarized in Tables 3-1 and 3-2.

TABLE 3

| No. | Basis material | Primer plating | Heat treatment time (sec) | Solderability* $T_2$ (sec) | Solderability* External appearance | Bonderability** Tensile strength (g) |
|---|---|---|---|---|---|---|
| | | | | Gold plated material | | |
| Invention Example | | | | | | |
| 1 | stainless steel | Ni—Co alloy | 0 | 0.14 | 0 | 7.6 |
| | | strike | 60 | 0.23 | 0 | 7.0 |
| | | (1) | 180 | 0.53 | 0 | 7.3 |
| 2 | phosphor bronze | Ni—Co alloy | 0 | 0.15 | 0 | 7.6 |
| | | strike | 60 | 0.24 | 0 | 7.2 |
| | | (2) | 180 | 0.60 | 0 | 7.4 |
| Comparative Example | | | | | | |
| 3 | stainless steel | Ni strike + | 0 | 0.80 | 0 | 8.0 |
| | | Ni—Co alloy | 60 | 0.60 | 0 | 7.6 |
| | | (0.1 μm) | 180 | 3.54 | Δ | 7.8 |
| 3 | stainless steel | Ni strike + | 0 | 0.73 | 0 | 7.9 |
| | | Ni—Co alloy | 60 | 0.69 | 0 | 7.3 |
| | | (0.5 μm) | 180 | — | X | 4.4 |
| 4 | phosphor bronze | Ni strike + | 0 | 0.52 | 0 | 7.6 |
| | | Ni—Sn alloy | 60 | 2.38 | 0 | 7.6 |
| | | (0.1 μm) | 180 | — | X | — |
| 4 | phosphor bronze | Ni strike + | 0 | 0.54 | 0 | 7.8 |
| | | Ni—Sn alloy | 60 | 2.22 | 0 | 8.1 |
| | | (0.5 μm) | 180 | — | X | — |
| 5 | stainless steel | Ni strike + | 0 | 0.26 | 0 | 8.1 |
| | | Pd—Ni alloy | 60 | 0.89 | 0 | 8.2 |
| | | (0.1 μm) | 180 | — | X | — |
| 5 | stainless steel | Ni strike + | 0 | 0.28 | 0 | 7.7 |
| | | Pd—Ni alloy | 60 | 0.84 | 0 | 8.5 |
| | | (0.5 μm) | 180 | — | X | — |
| | | | | Silver plated material | | |
| Invention Example | | | | | | |
| 1 | stainless steel | Ni—Co alloy | 0 | 0.33 | 0 | 7.5 |
| | | strike | 60 | 0.33 | 0 | 7.1 |
| | | (1) | 180 | 0.41 | 0 | 7.9 |
| 2 | phosphor bronze | Ni—Co alloy | 0 | 0.34 | 0 | 7.6 |
| | | strike | 60 | 0.38 | 0 | 7.3 |
| | | (2) | 180 | 0.42 | 0 | 7.4 |
| Comparative Example | | | | | | |
| 3 | stainless steel | Ni strike + | 0 | 0.65 | 0 | 7.9 |
| | | Ni—Co alloy | 60 | 0.75 | 0 | 7.7 |
| | | (0.1 μm) | 180 | 0.28 | X | 7.5 |
| 3 | stainless steel | Ni strike + | 0 | 0.73 | 0 | 7.9 |
| | | Ni+Co alloy | 60 | 0.69 | 0 | 8.0 |
| | | (0.5 μm) | 180 | — | X | 7.9 |
| 4 | phosphor bronze | Ni strike + | 0 | 0.41 | 0 | 7.5 |
| | | Ni—Sn alloy | 60 | 0.94 | 0 | 7.6 |
| | | (0.1 μm) | 180 | — | X | 7.7 |
| 4 | phosphor bronze | Ni strike + | 0 | 0.53 | 0 | 7.7 |
| | | Ni—Sn alloy | 60 | 1.21 | 0 | 7.2 |
| | | (0.5 μm) | 180 | — | X | 7.5 |
| 5 | stainless steel | Ni strike + | 0 | 0.28 | 0 | 7.7 |
| | | Pd—Ni alloy | 60 | 0.32 | 0 | 7.9 |
| | | (0.1 μm) | 180 | 0.32 | Δ | 8.1 |
| 5 | stainless steel | Ni strike + | 0 | 0.28 | 0 | 8.2 |
| | | Pd—Ni alloy | 60 | 0.32 | 0 | 7.8 |
| | | (0.5 μm) | 180 | 0.30 | Δ | 7.4 |

*Solderability: $T_2$: — Wettability was not exhibited at all. External appearance: 0 Wettability of 96% or higher. Δ Wettability of 40% or higher and less than 96%. X Wettability less than 40%.
**Bonderability: — Bonding was not feasible.

As apparent from Tables 3-1 and 3-2, the plated materials of the Invention Example had better solderability and bonderability compared with those of the Comparative Example. In connection with solderability in particular, it is understood that even after being subjected to the heat treatment for 180 seconds, the plated materials of the Invention Example showed substantially the same performance as the plated materials of the Comparative Example not subjected to the heat treatment.

What is claimed is:

1. An electroplating solution suitable for applying a cobalt-nickel alloy strike plating, which comprises about 5 g/l–300 g/l of nickel chloride, about 5 g/l–300 g/l of cobalt chloride and about 30 g/l–300 g/l of hydrochloric acid.

2. The electroplating solution as claimed in claim 1, which contains about 50 g/l–200 g/l of hydrochloric acid.

* * * * *